United States Patent [19]

Selke et al.

[11] Patent Number: 4,542,755

[45] Date of Patent: Sep. 24, 1985

[54] DRY-FORMING OF RECONSTITUTED TOBACCO AND RESULTING PRODUCT

[75] Inventors: William A. Selke, Atlanta; William F. Cartwright, Roswell, both of Ga.

[73] Assignee: Kimberly-Clark Corporation, Neenah, Wis.

[21] Appl. No.: 613,922

[22] Filed: May 25, 1984

[51] Int. Cl.[4] ..... A24B 3/14; A24B 9/00

[52] U.S. Cl. ..... 131/370; 131/369; 131/353; 131/365; 162/139

[58] Field of Search ..... 131/290, 353, 369, 370, 131/371, 372, 373, 374, 375, 365; 162/139

[56] References Cited

U.S. PATENT DOCUMENTS

| | | | |
|---|---|---|---|
| 2,706,695 | 4/1955 | Frankenburg | 131/355 |
| 3,012,562 | 12/1961 | Merritt | 131/355 |
| 3,185,161 | 5/1965 | Fliore et al. | 131/355 |
| 3,795,250 | 3/1974 | Halter | 131/355 |
| 3,872,870 | 3/1975 | Buchmann | 131/370 |
| 4,306,578 | 12/1981 | Schmidt | 131/353 |

*Primary Examiner*—Y. Harris-Smith

*Attorney, Agent, or Firm*—William D. Herrick

[57] ABSTRACT

An improved method of making reconstituted tobacco using a dry-forming process. Fiberized tobacco stems and scrap are combined with tobacco material of a fine particle size. The resulting tobacco mixture is conveyed in an airstream and deposited on a moving foraminous surface. An adhesive is incorporated into or applied to the web bonding the tobacco particles into a coherent sheet, and the sheet is dried if necessary. The dried sheet may be divided into leaflets or shredded for further processing as reconstituted tobacco. In preferred embodiments, cellulose fibers are mixed with the tobacco particles prior to web formation to impart increased sheet strength. In a further embodiment tobacco fines are mixed with the adhesive and applied to the web in the adhesive composition. Results obtained by means of the present invention include cost savings particularly in terms of reduced capital costs. Because the tobacco is used substantially in its natural state, the aroma and other desirable tobacco attributes are retained.

15 Claims, 3 Drawing Figures

DRY-FORMING OF RECONSTITUTED TOBACCO AND RESULTING PRODUCT

BACKGROUND OF THE INVENTION

1. Field of the Invention

The invention relates to reconstituted tobacco and methods for its production. In general, the production and processing of tobacco products includes the steps of aging, blending, cutting, drying, cooling, screening, shaping and packaging which generate considerable amounts of tobacco fines and dust. Furthermore, tobacco midribs, called stems, are not considered useful directly in producing such products and are separated from the tobacco leaf. Rather than discard these fines, powder and stems, it has been customary to form them into a sheet material resembling leaf tobacco and commonly referred to as reconstituted tobacco. There are currently three processes used commercially to form reconstituted tobacco: the two-step paper process, the single-step paper process, and the casting process. Each of these processes involves forming a liquid slurry or paste, and they all have in common high drying energy requirements. In addition, the paper making processes have high capital costs and commonly result in losses of material to the sewer. The casting process, on the other hand, while having a relatively low capital cost, is still essentially a wet process and results in marginal physical properties as well as requiring the use of large amounts of gum binder. The present invention is directed to an improved method for forming reconstituted tobacco that avoids these drawbacks and to the resulting reconstituted tobacco product.

2. Description of the Prior Art

As mentioned above, one conventional method for manufacturing reconstituted tobacco involves standard papermaking techniques. In this case, prior to refining, the tobacco is usually soaked in water to extract the water soluble portion. The aqueous extract is put aside and after the fibrous tobacco remainder is refined and formed by conventional papermaking techniques, the extract is reintroduced into the web and final drying takes place. For example, U.S. Pat. No. 4,182,349 to Selke dated January 8, 1980 describes this process and improvements thereto relating to the refining step. A second process in use is to dry grind or mill tobacco leaves, stocks or stems, add the grindings to an aqueous or other liquid carrier and, after addition of a binder, cast the moist mass onto a stainless steel belt or other carrier. The web is then dried to the desired moisture content. U.S. Pat. No. 3,429,316 to Hess, dated February 25, 1969 describes improvements to the casting process including particular additive materials and also discusses similar steps for making reconstituted tobacco. Variations of the casting process are also taught in U.S. Pat. Nos. 2,734,510 and 2,734,513, both to Hungerford, et al. and dated Feb. 14, 1956 and incorporating the use of a film forming binder matrix. Known processes have in common the use of water or another liquid vehicle for web formation. While the amount of such a liquid vehicle varies considerably, in all cases it must be at least sufficient to form a doughy mass, and usually is in amounts sufficient to at least form a slurry. Further, to achieve satisfactory properties, it is frequently taught as necessary to extract tobacco liquor and return it to the formed sheet. In such processes where large volumes of water are utilized, environmental concerns necessitate steps to assure that any undesirable impurities are removed from process water prior to returning it to streams or local water systems. Other problems relating to the use of water vehicles and processes for reconstituting tobacco are described in U.S Pat. No. 3,310,057 to Savage, Midland and Aldrich dated March 21, 1967.

It is also known, generally, to form paper webs by dry forming processes. Since Fourdrinier paper machines historically have required large volumes of water necessitating further processing and disposal, much effort has been directed to dry forming of paper. Representative examples of such processes are described in U.S. Pat. No. 3,575,749 to Kroyer dated April 20, 1971 and U.S Pat. No. 3,669,778 to Rasmussen dated June 13, 1972. Such dry forming processes for paper manufacture have not, however, achieved widespread success due to a failure to achieve desired strength properties on an economic basis. Moreover the investigation of such processes has heretofore been limited to woodpulp fibers due to the high degree of fiberization essential to obtain fiber separation and a uniform product.

In summary, the available art demonstrates the need for improved techniques to form reconstituted tobacco and products that would improve the economies of such materials while maintaining or improving desired properties.

SUMMARY OF THE INVENTION

The present invention provides a dry forming process for forming reconstituted tobacco and the resulting reconstituted tobacco product. In accordance with the invention the tobacco stems, lamina and fines are entrained in a gas medium, deposited on a foraminous carrier and adhesively bonded into a sheet material. The stems are fiberized and reduced to fiber bundles (e.g., a small band of mostly parallel fibers) prior to incorporation into the web. In a preferred embodiment, woodpulp cellulose or other natural fibers are added to the fiberized stems, and the combination mixed with the remainder of the leaf particles and dust materials in an airforming step producing a web on a foraminous wire or surface. This web is then bonded by means of an adhesive, and the bonded sheet is stored or cut into pieces for use as reconstituted tobacco. The process of the present invention avoids the need for extraction of tobacco components, and it also eliminates the need for a liquid vehicle which must be removed and handled as a waste material. The reconstituted tobacco product of the present invention is characterized by high void fractions while maintaining desirable aroma and smoking properties. In preferred embodiments, the woodpulp fibers are included in an amount of about 4 to 12% by weight and the adhesive is selected from the natural and synthetic gums commonly used in conjunction with tobacco products. Natural gums may be starches, guar, locust bean gum, tamarind and the like. Synthetic gums include the chemically modified natural gums as well as cellulosics such as sodium carboxymethylcellulose, Methocel TM , and the like. Further, in accordance with the invention, the stem fraction may be in the range of 0% to 100% for the tobacco portion. The actual percentage of stem utilized is dependent only on the amount available from cigarette manufacturing operations which frequently will be in the range of from about 20% to 80%. An additional preferred embodiment includes the addition of up to about 5% by weight of a humectant such as glycerine, propylene glycol, butylene glycol, sorbitol or trimethylene glycol to reduce the incidences of undesirable cracking of the sheet thereby generating short shred lengths. Finally, the adhesive composition may further contain wetting agents or wet or dry strength agents such as Kymene TM or glyoxal depending on the desired properties of the end product. Additional preferred embodiments and other variations are set forth in the detailed description.

DESCRIPTION OF THE PREFERRED EMBODIMENTS

Figure 1:
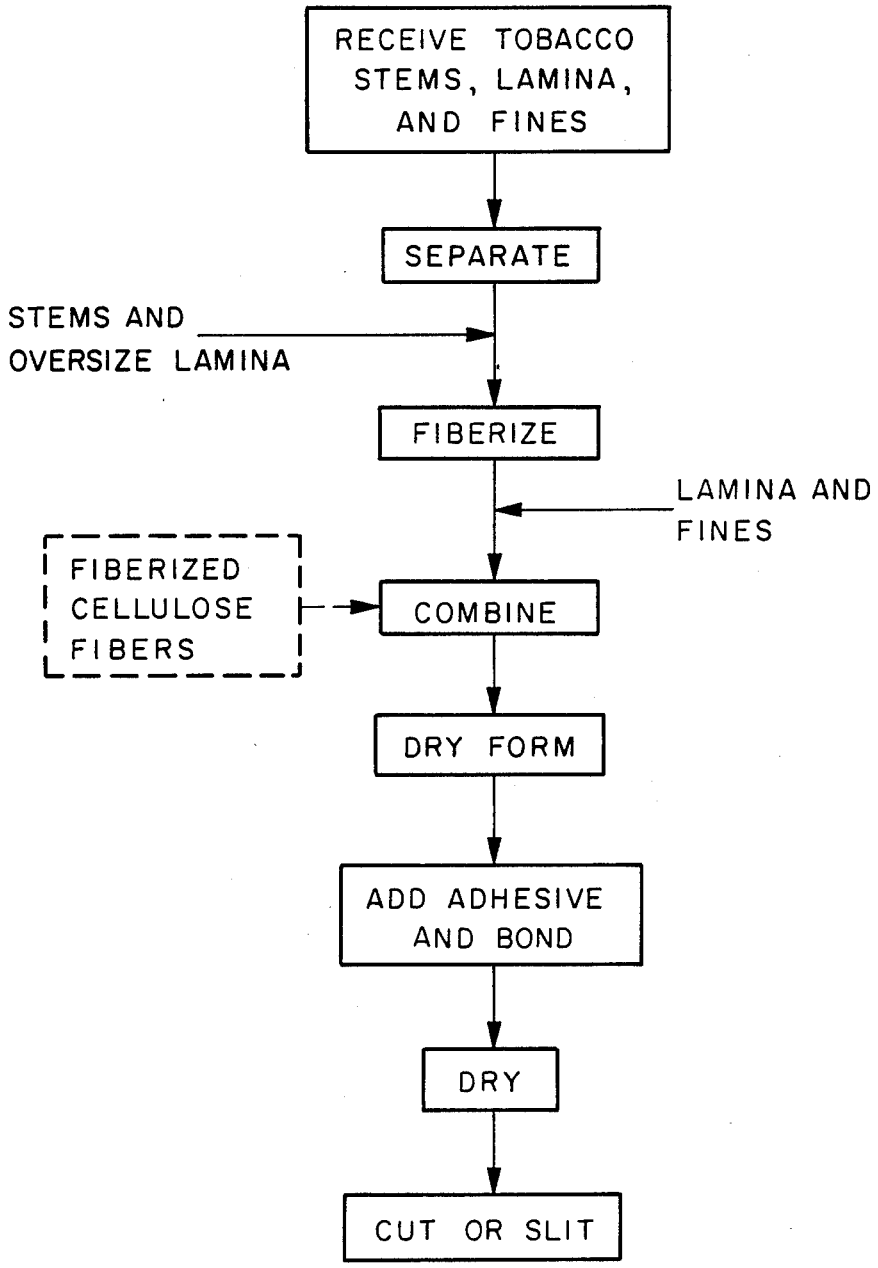
FIG. 1 is a generalized flow sheet of the process of the present invention.

While the invention will be described in connection with preferred embodiments, it will be understood that it is not intended to limit the invention to those embodiments. On the contrary, it is intended to cover all alternatives, modifications and equivalents as may be included within the spirit and scope of the invention as defined by the appended claims.

In description of the present invention certain test results will be set forth. These tests were carried out as follows:

Filling Power

Filling Power was determined by a cylinder method. The sheets of reconstituted tobacco were made into cigarette-type shred using guillotine cutters. After conditioning 72 hours at 62% RH and 72° F., 10 grams of the shred were placed in a 100 cc graduated cylinder. After levelling the shred in the cylinder, a plastic rod (grooved to permit air passage) was lowered into the graduated cylinder. The rod weighed 123 grams. A weight (1076 grams) was placed on top of the plastic rod. Under these conditions, a standard cigarette tobacco blend, containing no puffed tobacco, will compress to a density of 0.28 grams/cc. The column of tobacco is allowed to compress for two minutes, at which time the volume of the cylinder it then fills is recorded as the filling power in cc's per 10 grams.

Frangibility

Frangibility in terms of percent was determined by first cutting the dry formed reconstituted tobacco sheet into cigarette-type shred using guillotine cutters. The shred was then shaken briefly on a 20-mesh screen to remove small particles. After conditioning 72 hours at 62% RH and 72° F., the shred was passed five times through a Hauni "Baby" cigarette maker. The frangibility, which is a measure of the tendency toward breakage in a cigarette making operation, is defined as weight percent of fragments passing the 20-mesh screen.

Dry Particulate Material ("DPM")

Dry particulate material results were obtained by the standard FTC cigarette smoking procedure. Eighty-five mm long cigarettes were made and conditioned 72 hours at 62%RH, 72° F. The condensate was collected on Cambridge filter pads and the moisture determined by gas chromatography.

Taste Characteristics

Smoke taste characteristics were obtained by a trained panel. Further evaluations were conducted by a flavor/taste expert specializing in tobacco taste and flavorings.

Chopping Dust

Sheets of reconstituted tobacco were first conditioned 72 hours at 62%RH and 72° F. A known amount was then made into cigarette-type shred using guillotine cutters. Chopping dust is defined as the weight percent of fragments produced from the cutting operation which pass a 20-mesh screen. This value is a measure of the tendency toward breakage during cigarette rag making and, as such, is correlated with frangibility.

Mercury Void Fraction

The mercury void fraction is determined by a mercury intrusion technique and is calculated from the weight difference of a small square of reconstituted tobacco sheet weighed in air and weighed while immersed in mercury. The mercury void fraction represents the "pore" or open volume as opposed to the conventional "density" which is weight per unit volume. The mercury void fraction relates to combustion characteristics with high mercury void fractions being beneficial as described by C.F. Mattina and W.A. Selke ("Reconstituted Tobacco Sheets", Proceedings, Third World Conference, Smoking and Health, pp. 67–72, 1975).

Certain other definitions will be helpful in obtaining a complete understanding of the present invention. For the purposes of the present description, tobacco ingredients of reconstituted tobacco include scrap leaf portions and fragments that are large enough to be retained by a 60 mesh screen. The midribs of the tobacco leaf are referred to as "stems". For purposes of this description "fines" include those tobacco materials which pass through a 60 mesh screen. While it will be apparent to those skilled in this art that the precise dividing lines for these materials is subject to variation depending upon the desired results to be obtained, these terms will be used herein as defined although it is not intended that the invention be limited by the specific recited ranges.

The process of forming reconstituted tobacco provides a way to obtain maximum utilization of portions of tobacco which would otherwise be wasted. Those leaf components not suitable for use directly as such in forming cigarettes, cigars, pipe tobacco and the like, are formed into a sheet material that can be cut or slit into sizes suitable for incorporation into such products. Obviously, requirements for reconstituted tobacco include that they do not provide significant adverse effects on taste, delivery, smoking properties and the like.

Turning to FIG. 1, the reconstituted tobacco manufacturing process of the present invention will be generally described. As shown, the first step is to obtain the tobacco materials for processing. In the case of the tobacco grower, these materials will be readily obtained since the tobacco processing necessitates their separation. The stems, which are relatively thick and normally woody are preferably fiberized and broken down into fibrous fragments or fiber clumps which preferably have a high aspect ratio (length divided by width) to increase sheet strength. These stem fragments may be combined with cellulose pulp fibers which are preferably incorporated to aid in overall web bond strength. These stem fibers and wood pulp fibers next may be combined or entrained in a gas stream, normally air, with the lamina fragments and fines. This combination is deposited on a foraminous surface, and a binder added. After the binder has been activated, the web has sufficient strength for processing as reconstituted tobacco and may be divided into desired sizes. While this generalized description forms the basis for the process of the present invention, other variations will be apparent to those skilled in the art, and several are described in further detail below.

Figure 2:
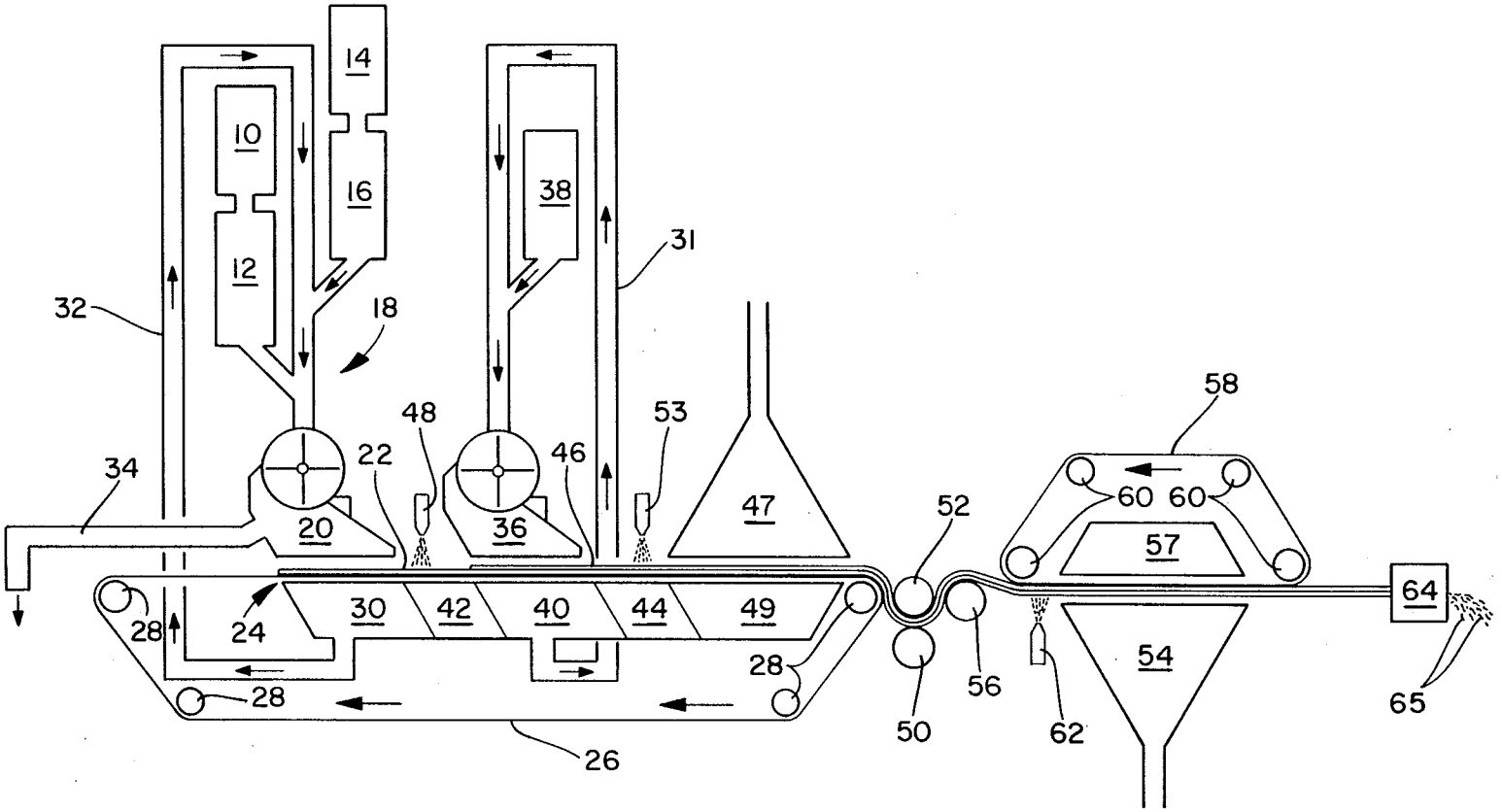
FIG. 2 is a schematic illustration of the process of the present invention.

Turning to FIG. 2, the invention will now be described with respect to a preferred embodiment. As illustrated, the system includes tobacco blend chest 10 and tobacco meter 12. Blend chest 10 receives lamina and stem fragments which are broken into desired fiber clumps as above described. Cellulose fibers are provided, if desired, by blend chest 14 through meter 16. Devices for fiberizing cellulose may be selected from those known in the art for such purposes, for example, in the fiberizing of pulp for disposable diapers and the like. Such include devices available from Rando Machine Co., known as Rando Webbers as well as other pickers and divilicators. One example of such a device is described in U.S. Pat. No. 3,606,175 to Appel and Sanford entitled "Picker for Divilicating Pulp" dated Sept. 21, 1971 which is incorporated herein by reference.

The output from meters 12 and 16 are combined at 18 and directed to forming head 20. This device operates as a distributor to uniformly lay the fiber composition 26 as a web 22 on the foraminous collection surface 24, as shown a belt 26 moving about support rolls 28, one or more of which may be driven by a motor or other means (not shown). To assist the web formation, vacuum box 30 is provided which also serves to remove fibers passing through the foraminous surface 24. These fibers removed may be recirculated by conduit 32 to combination zone 18 for further processing. In the embodiment shown, former 20 serves also as a source of larger particles through conduit 34 which larger particles may be fiberized or directed to tobacco blend chest 10. The embodiment shown also includes forming head 36 which may be of similar construction to that of forming head 20. The forming head 36 may be used to incorporate fines supplied by chest 38. These forming heads are also of the construction known to those skilled in the paper making art such as are described, for example, in U.S. Pat. No. 3,581,706 to Rasmussen dated June 1, 1971 which is incorporated herein by reference. These include a moving screen and rotary blade causing the fibers to enter the air delivery stream and be directed in a uniform manner on the receiving surface.

An additional vacuum box 40 is included in cooperation with former 20 and may direct the material drawn through the wire 26 by conduit 31 back to chamber 38 or to collection bags or the like. Additional vacuum boxes 42, 44 may be employed to retain the webs on wire 26. Binder adhesive may be added at 48, if desired to bond web 22. After formation of combined web 46, the web 46 is directed under sprayer 53 where binder is applied. While a spray device is illustrated, other means for binder application known to those skilled in the art will be apparent. Such include, without limitation, rolls, dip baths, and the like. For ease of drying, however, spray application is preferred. After the binder is applied, the web 46 may be initially dried by throughdryer 47 including vacuum 49, and then is densified by passing between nip rolls 50 and 52 and over support roll 57 to throughdryer 54 where the binder is set or cured. The degree of densification will also vary but will generally be to a density in the range of from about 0.1 to 0.7 g/cc, perferably about 0.3 to 0.5 g/cc for most reconstituted tobacco applications. It should also be understood that densification can occur at numerous points within the process and that, preferably, densification occurs while the web is in a damp state. Throughdryer 54 is shown in combination with vacuum box 56 and belt 58 supported by rolls 60. Additional binder may be added at 62 if desired. The resulting dried reconstituted tobacco may then be calendered, if desired, or directed to cutter or shredder 64 where desired size fragments 65 for the intended reconstituted tobacco use are formed.

The present invention is useful with tobaccos of all types and varieties. The extent to which the tobacco fragments must be fiberized will vary according to the starting tobacco material and the desired end use. For example, with most types of tobacco, the fiberization step will easily accomplish the desired degree of defiberization. This will generally include reduction of stems to fiber bundles predominantly having a high aspect ratio, i.e., ratio of length to width, to further increase sheet strength. The aspect ratio will preferably be in the range of from about 5:1 to 20:1, although other ratios may also be used. Useful equipment for this purpose is known in the production of absorbent bats for disposable uses such as sanitary napkins and the like. Other fiberizers which will be useful will be apparent to those skilled in this art.

When cellulose fibers are employed for strength enhancement, they are preferably used in minor amounts, for example, in the range of from about 3% to about 20% and, preferably, from about 4% to about 12% by weight of the finished reconstituted tobacco web to avoid undesirable effects on taste and/or aroma. It is not important that any particular type of wood pulp be employed, and many examples will suggest themselves to those skilled in this art. Normally, however, the woodpulp fibers exhibit an average length of more than about 2 mm, and are commonly constituted essentially of softwood species. The pulps are delignified as by chemical pulping such that lignin, other non-cellulose wood components, waste, and so forth are essentially removed, and the fibers, which are essentially cellulose with a high degree of purity, are then separable and dispersible in the dry forming step.

The binder employed may also be selected from a wide variety of materials. However, such materials must be compatible with the other tobacco components and acceptable as a cigarette or smoking article ingredient. Examples of such binders that are water soluble are described in U.S. Pat. No. 3,310,057 to Savage and Aldrich dated Mar. 21, 1967 such as methocellulose, hydroxyethyl cellulose, carboxymethyl cellulose, or mixed cellulose ethers. Preferred for cost reasons, however, are the less expensive binders such as guar gum or starches. Mixtures of some of these binders may also be employed. For example, one such preferred binder system includes a mixture of guar gum and starch. The binder may include up to about 5% by weight of a humectant such as glycerine, propylene glycol, butylene glycol, sorbitol, or triethylene glycol. The binder may also include up to about 1500% based on the weight of binder, alone, of tobacco fines which also enhance bonding. The amount and type of binder employed will depend upon the desired properties for the reconstituted tobacco sheet. In general, however, the binder added in a liquid carrier is minimized for reduced drying requirements, so that, for example, total liquid pick-up relative to the dry weight of the product is less than about 100%. The tensile strength of the product can vary over a wide range and need only be sufficient for the product to function in its intended usage. For most purposes, the frangibility and chopping dust measurements are more appropriate. With these properties the reconstituted tobacco sheet will have sufficient integrity for subsequent equipment handling and converting purposes.

While the gas used for the dry forming step will normally be air, other gasses may be employed if desired. The volumes used will need to be sufficient to obtain adequate mixing and distribution of the tobacco and other components, but will, otherwise, be minimized to avoid unnecessary handling. The gas will normally be at its available temperature and other conditions but may be treated, if desired; for example, humidification may be desirable to avoid static discharges. In addition, other ingredients may be mixed with the fibers in the air stream such as taste, aroma, or other enhancers. In addition fillers such as chalk, carbon, or the like may be added in a range of up to about 30%, preferably up to about 15% by weight of the finished reconstituted tobacco product if desired.

Drying of the bonded web, if necessary, may be accomplished by a wide variety of known drying techniques. For example, steam heated can dryers may be employed. Preferably, however, the web is dried by means of a through-dryer which will accomplish rapid drying throughout the web. The degree to which the web is dried is not critical, but, preferably, it is dried to less than 15% moisture content. After drying the web may be calendered by passing between pressure rolls. The dried web may then be subdivided by conventional means into desired shapes for processing as reconstituted tobacco.

Figure 3:
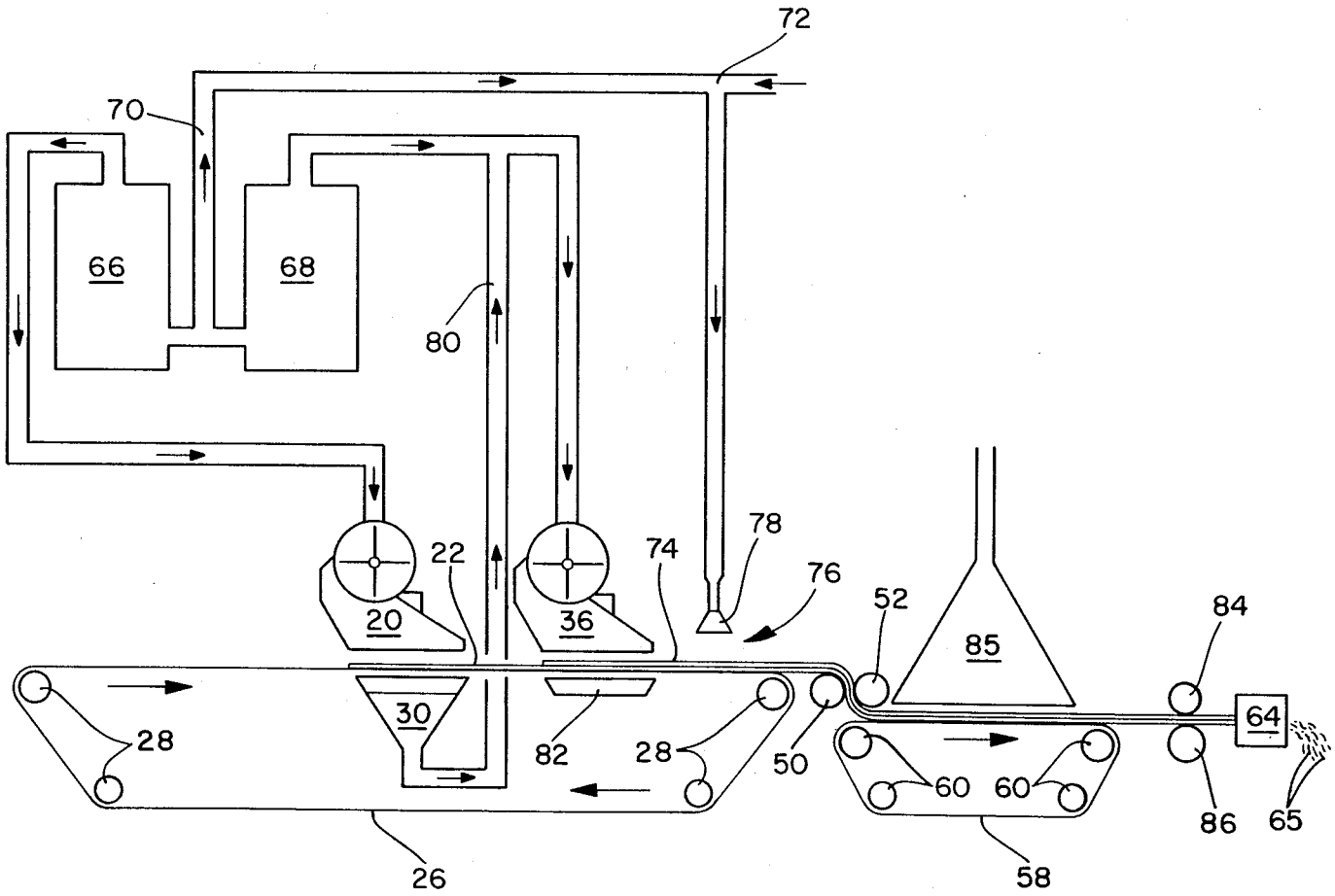
FIG. 3 is a schematic of the same nature as FIG. 2 with respect to an alternative process embodiment.

Turning to FIG. 3, a modified configuration for the present invention will be described. The arrangement is as in FIG. 2, except that dual fiberizers 66 and 68 are employed to break-up the stems and to fiberize cellulose. The fines from both fiberizers are combined through conduit 70 with binder at 72, and the combination applied to web 71 at 76 using applicator 78. This combination further improves bonding by means of the cellulose particles. As in the arrangement of FIG. 2, wire 26 collects the deposited materials and is guided by support rolls 28. Also similarly, forming heads 20 and 36 are used with vacuum 30 providing recycle via conduit 80 and vacuum 82 collecting for discard. In the arrangement of FIG. 3, however, only a single dryer 84 is employed after densification rolls 50, 52 and in connection with wire 58 supported by rolls 60. Also in the case illustrated in FIG. 3 calender rolls 84, 86 are positioned just prior to shredder 67 for final web compaction. In this embodiment the fines serve not only as a filler but to enhance bonding properties as well.

EXAMPLES

The invention will now be described with reference to specific examples which are for purposes of illustration only.

EXAMPLE 1

For this example the tobacco portion was introduced by a vibrating feeder and mixed with wood fibers obtained from a Rando Webber. The mixture was conveyed by an airstream into a forming head where the heavier tobacco particles were withdrawn. Forming was made on a moving wire and assisted with a vacuum box positioned below the wire. Fines passing through the wire were returned for reuse. The bonding station comprised a binder spray, and a steam throughdryer was used for drying. Prior to introduction to the system, the tobacco particles were separated by sieving into those fractions within 8 to 60 mesh and those below 60 mesh. The stem portions were fiberized prior to introduction into stem bundles having a high aspect ratio of length to width. The stems were subjected to refining in a Sprout-Waldron refiner using fine pattern (D2A505) plates. The plate tolerance was set at 25 to 30 one thousandths of an inch which resulted in no large chunks. Stem fiberization was also accomplished using a Pallmann Turbo-Pulverizer. For improved fiberization it is preferred that the moisture content of the stems be raised to 25% to 45% to avoid reducing stem material to powder. The exact moisture content required is dependent to some extent on the type of equipment used for fiberization. Moisture content was controlled either by use of pressurized steam or by spraying the stems with water and allowing subsequent equilibration in sealed containers.

Blending of the materials was accomplished to produce 11 different blends as set forth in Table 1. The first four formulations represent unsieved tobacco materials, identified as Examples 1A through 4A. Two additional formulations were obtained using stems that were one-half fiberized using Pallman Turbo-Pulverizer equipment and the other half fiberized using the Sprout-Waldron equipment. The results were essentially the same as for Examples 2A and 4A. Samples 7B through 10B incorporated only sieved tobaccos in the size of 8–60 mesh. The eleventh blend, Example 11, consisted entirely of Sprout-Waldron fiberized stems as the tobacco component. For all examples, woodpulp, if used, was bleached Southern pine softwood pulp. As stated above, unbleached woodpulp may be used, preferably in roll form, and the use of a debonder is optional. The former device was of the type described in Chung U.S. Pat. No. 4,375,447 dated Mar. 1, 1983 using a Tyler Combustion Engineering former screen identified as 930 Ton Cap Screen which had an open area of 51.8%, an opening size of 0.085 inches and a wire diameter of 0.054 inches. To eliminate blowing off of fibers, a coarser, 732 Ton Cap Screen was used having an open area 49.5% with opening size of 0.111 square inch in a wire diameter of 0.080 inch. The receiving wire was a Teflon-coated fine mesh wire having 20% open area and made by Appleton Wire Works. The dryer wire was a heavy, bronze 8×10 mesh wire with 49% open area and an opening size of 0.25 inch. This improved the ability of the throughdryer to pass heated air through the reconstituted tobacco sheet. The wood fiber feed from the Rando Webber device was set to deliver 6 to 12 grams per square meter of woodpulp fiber. A tobacco blend was metered into the air feed system using a vibrating feeder calibrated to deliver about 500 grams per minute of tobacco particles. For each run the feeder rate was adjusted to deliver the desired final basis weight (75 to 125 gsm) including an estimated 8% moisture content.

Bonding was achieved by spraying with a sodium carboxymethyl cellulose solution (9M31) which, although not necessary to the invention, included 10% of a wet strength agent. The basis weight was achieved by the appropriate feed rate using the vibrating feeder. Where "fines" (material pasing 60 mesh) were added separately two passes were necessary to achieve the final basis weight (about 25 gsm "fines" were added to the initial basis weight of 75–85 gsm). Where unsieved tobacco blends were used, a single pass at the appropriate feed gave a finished product of 100–125 gsm. While the examples were run at a machine speed of about 100 fpm due to associated equipment and availability of raw materials, subsequent machine speed trails reached 400 fpm, and it will be recognized by those skilled in this art that commercial equipment will be capable of much higher speeds, for example, up to 1500 fpm or more. The finished sheet contained 3% NaCMC by weight. Glycerine was added to some of the samples as indicated in Table 4, at a 1% by weight add-on.

While the described arrangement and method were used in carrying out the described examples, it will be recognized by those skilled in this art that variations will be desired for improved operation, including a single-pass process as illustrated in FIGS. 2 or 3 for example.

Material loss to the recycle bag from the head former was a function of the stem content. Example 1A, containing only lamina/fines lost ca. 3% to the recycle bag whereas Example 3A, with 70% fiberized stems, lost 14% to the recycle bag. With optimum fiberization, and system recycling, such losses would be essentially eliminated. The total fraction captured for recycling could be as high as 30% of the total tobacco feed, but, in accordance with the invention, essentially 100% utilization is achieved through recycling.

TABLE 1

RECOVERABLE TOBACCO TO BE RECYCLED DURING WEB FORMATION

| Example Number[1] | Nominal Stem/Lamina Ratio | POUNDS RECOVERED Dust Collector Bag | POUNDS RECOVERED Recycle Bag | Percent Loss[2] |
|---|---|---|---|---|
| 1A | 0/100 | 8.3 | 1.7 | 20 |
| 2A | 30/70 | 8.4 | 2.9 | 23 |
| 3A | 70/30 | 6.2 | 7.0 | 26 |
| 4A | 52/48 | 6.6 | 4.3 | 22 |
| 7B | 0/100 | 7.8 | 0.8 | 17 |
| 8B | 30/70 | 6.4 | 4.1 | 21 |
| 9B | 70/30 | 5.7 | 5.5 | 22 |
| 10B } 3 | 52/48 | 5.1 | 2.7 | 16 |
| 11 } 3 | 100/0 | | | |
| Dust Applications | Sum For All Runs | 14.2 | 0.5 | 30 |

[1]Formulas 1–4 used unsieved tobacco; formulas 7–10 used sieved tobacco; formula 11 was unsieved.
[2]Based on 50 pounds feed per formula.
[3]Combined run - the use of Sprout-Waldron fiberized stems in formula 11 produced a "tighter" sheet (less loss through wire).

The following tables provide physical test results of the webs in accordance with the invention and as compared with a coventional reconstituted tobacco sheet formed by the wet-laying process.

TABLE 2

Comparison of Conventional Wet-Formed and Air-Formed Reconstituted Tobacco Physical Characteristics

| Analysis | Wet-Formed[1] | Air-Formed[2] 3% CMC | Air-Formed[2] 5% CMC |
|---|---|---|---|
| Basis Wgt. Dry, gsm | 102 | 106 | 108 |
| Thickness, Mils | 8 | 12 | 11.5 |
| Apparent Density, grams/cc | 0.54 | 0.32 | 0.36 |
| Mercury Void Fraction | 0.50 | 0.71 | 0.64 |
| Chopping Dust, Percent | 7 | 19 | 8 |
| Filling Power, cc/10 grams | 40 | 41 | 40 |
| Frangibility, percent | 3 | 13 | 4 |
| Equilibrium Moisture, Percent (62% RH, 72° F.) | 12 | 11 | 11 |

[1]Average of 6 samples
[2]Average of three samples for density and thickness; others are average of eleven samples.

TABLE 3

Comparison of Conventional Wet-Formed Reconstituted Tobacco and Individual Blends by Dry Forming Physical Characteristics

| | Wet-Formed[1] | Air Formed Examples[2] 5% NaCM Binder A | B | C | D |
|---|---|---|---|---|---|
| Dry Basis Wgt., gsm | 102 | 109 | 102 | 110 | 110 |
| Mercury Void Fraction | 0.50 | — | 0.63 | — | 0.65 |
| Chopping Dust, Percent | 7.4 | 7.8 | 7.4 | 8.6 | 5.5 |
| Filling Power, cc/10 grams | 40 | 37 | 41 | 41 | 42 |
| Frangibility, Percent | 3.3 | 4.0 | 3.4 | 5.2 | 6.4 |
| Equilibrium Moisture, Percent (62% RH, 72° F.) | 11.6 | 11.2 | 13.5 | 11.3 | 11.7 |

[1]Average of 6 individual samples
[2]After impregnation with an additional 2% NaCMC 9M31. All Examples contained 1% glycerine. Example A had 6 gsm wood fiber. Example B had 8 gsm and Examples C and D had 12 gsm.

Cigarettes were prepared from reconstituted tobacco sample blends as follows:

(a) all tobacco lamina with 8 grams per square meter wood fiber;
(b) 30% stem and 70% lamina for the tobacco portion plus 12 grams per square meter wood fiber; and
(c) 52% stem and 48% lamina for the tobacco portion plus 12 grams per square meter wood fiber.

All samples contained 1% glycerine by weight. These cigarettes were smoked to determine deliveries of total particulate, carbon monoxide and carbon dioxide. The results were essentially the same as those for conventional wet-formed reconstituted tobacco. In a subjective taste test the cigarettes using reconstituted tobacco formed in accordance with the invention were judged comparable in taste to those formed with conventional wetlaid reconstituted tobacco. In addition, the aroma for cigarettes made with reconstituted tobacco made in accordance with the present invention are improved due to the elimination of the need to evaporate large amounts of water with attendent steam distillation of tobacco aroma volatiles. The reconstituted tobacco of the invention was also characterized by a high void fraction, for example, above 0.5.

Thus the present invention provides a highly improved method of forming reconstituted tobacco avoiding the necessity for moisture addition and concomitant capital, energy and waste related costs. These benefits are obtained while maintaining or improving the resultant reconstituted tobacco product. Thus it is apparent that there has been provided, in accordance with the invention, a method of forming reconstituted tobacco and resultant product that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications, and variations as fall within the spirit and broad scope of the appended claims.

We claim:

1. A method of forming reconstituted tobacco comprising the steps of:

(a) providing tobacco particles;

(b) entraining said tobacco particles in a gas medium;

(c) directing said gas and entrained tobacco particles onto a moving foraminous carrier to form a web; and (d) adhesively bonding said web.

2. The method of claim 1 wherein said tobacco particles are selected from the group consisting of lamina, stems and fines.

3. The method of claims 1 or 2 including the additional step of adding cellulose fibers to said tobacco in an amount of about 3% to about 20% by weight of the dry web.

4. The method of claim 1 wherein the adhesive bonding is carried out by means of an adhesive selected from the group consisting of natural and synthetic gums, starches and mixtures thereof.

5. The method of claim 3 wherein the adhesive selected from the group consisting of natural and synthetic gums, starches and mixtures thereof.

6. The method of claim 3 wherein said gas is air.

7. The method of claim 4 wherein said adhesive also includes up to 1500% by weight tobacco fines based on the weight of adhesive.

8. The method of claim 3 further including the step of densifying said web.

9. The method of claim 3 wherein said adhesive is applied as a liquid spray to said web and further including the step of drying said adhesively bonded web.

10. The method of claim 2 including the step of fiberizing said stems to produce fiber bundles with a high aspect ratio prior to entrainment in said gas medium.

11. A method of forming reconstituted tobacco comprising the steps of:

(a) providing a mixture of tobacco particles selected from the group consisting of lamina particles, fines and fiberized stems having a high aspect ratio, (b) adding to said mixture a minor amount of cellulose fibers, (c) entraining said mixture and cellulose fibers in an air stream, (d) directing said airstream containing said mixture and fibers onto a moving foraminous collecting surface to form a web, (e) adding an adhesive to said web selected from the group consisting of starches and natural and synthetic gums and mixtures thereof, and (f) bonding said web by means of said applied adhesive.

12. The method of claim 11 further including the step of densifying said web by passing it through a nip formed by a pair of compaction rolls.

13. The method of claim 11 including the step of adding glycerine to said web.

14. The method of claim 12 further including the step of dividing said densified web into fragments useful in cigarette tobacco compositions.

15. The product of the method of claims 1 or 11.

* * * * *